US008115389B2

(12) United States Patent
Kasaishi et al.

(10) Patent No.: US 8,115,389 B2
(45) Date of Patent: Feb. 14, 2012

(54) HIGH PRESSURE DISCHARGE LAMP

(75) Inventors: Shuki Kasaishi, Himeji (JP); Satoru Umezaki, Himeji (JP); Yoichi Mukaino, Himeji (JP)

(73) Assignee: Ushio Denki Kabushiki Kaisha, Tokyo (JP)

( * ) Notice: Subject to any disclaimer, the term of this patent is extended or adjusted under 35 U.S.C. 154(b) by 218 days.

(21) Appl. No.: 12/700,439

(22) Filed: Feb. 4, 2010

(65) Prior Publication Data

US 2010/0201266 A1 Aug. 12, 2010

(30) Foreign Application Priority Data

Feb. 9, 2009 (JP) ..... 2009-026948

(51) Int. Cl.
*H01J 17/18* (2006.01)
*H01J 61/36* (2006.01)

(52) U.S. Cl. .... 313/623; 313/624; 313/625; 313/318.07

(58) Field of Classification Search ..... 313/623–625, 313/631–636, 573–575; 445/29, 46, 49, 445/52

See application file for complete search history.

(56) References Cited

U.S. PATENT DOCUMENTS

| | | | | |
|---|---|---|---|---|
| 4,370,589 | A * | 1/1983 | DeCaro et al. | 313/579 |
| 4,703,221 | A * | 10/1987 | Ochoa et al. | 313/579 |
| 2005/0003729 | A1 | 1/2005 | Mizobe | |
| 2008/0185950 | A1 | 8/2008 | Claus et al. | |
| 2009/0121635 | A1 | 5/2009 | Nagamachi et al. | |
| 2010/0295448 | A1 * | 11/2010 | Takagaki et al. | 313/623 |
| 2011/0043110 | A1 * | 2/2011 | Tsukamoto et al. | 313/631 |

FOREIGN PATENT DOCUMENTS

| | | | |
|---|---|---|---|
| EP | 1 465 235 | A2 | 10/2004 |
| JP | 28-5241 | | 10/1953 |
| JP | 6-162993 | A | 6/1994 |
| JP | 2000-164172 | A | 6/2000 |
| JP | 2006-196267 | A | 7/2006 |
| JP | 2007227329 | A * | 9/2007 |
| JP | 2009-75121 | A | 4/2009 |
| JP | 2011034759 | A * | 2/2011 |
| WO | 2008/119375 | A1 | 10/2008 |

* cited by examiner

*Primary Examiner* — Mariceli Santiago
(74) *Attorney, Agent, or Firm* — Roberts Mlotkowski Safran & Cole, P.C.; David S. Safran

(57) ABSTRACT

To provide a high pressure discharge lamp in which no fusing of the metal foil occurs even if the high pressure discharge lamp is switched on for a certain time a high pressure discharge lamp is provided having a discharge vessel comprised of a light emission part and sealing parts made of glass connected to opposite ends of said light emission part; metal foils buried in a respective one of said sealing parts; a pair of electrodes comprised of core rods and tip end parts, said tip end parts being arranged oppositely to each other in the light emission part; and said core rods being melted and fused together with a respective one of the metals foils; wherein cavities are formed which reach from a surface of a respective one of the metal foils to an interior of the core rod, and the glass constituting said sealing part has entered into said cavities.

4 Claims, 2 Drawing Sheets

Fig. 1
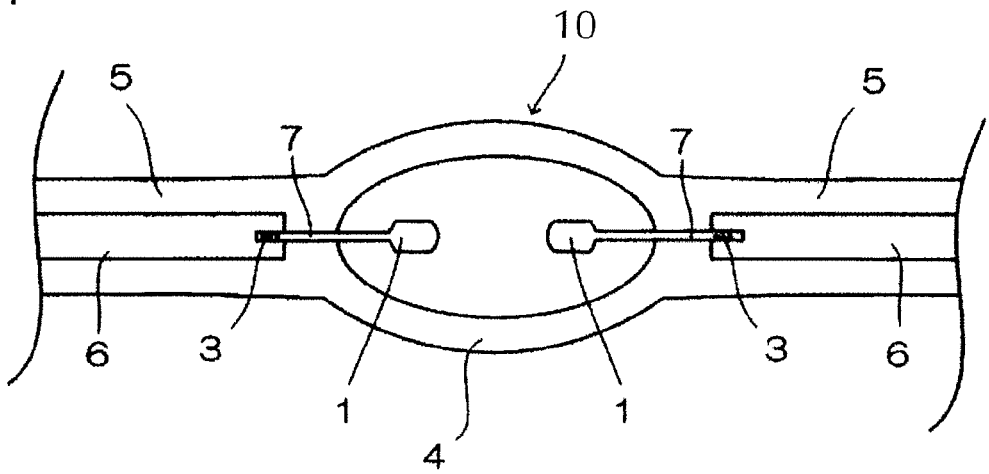
Fig. 2
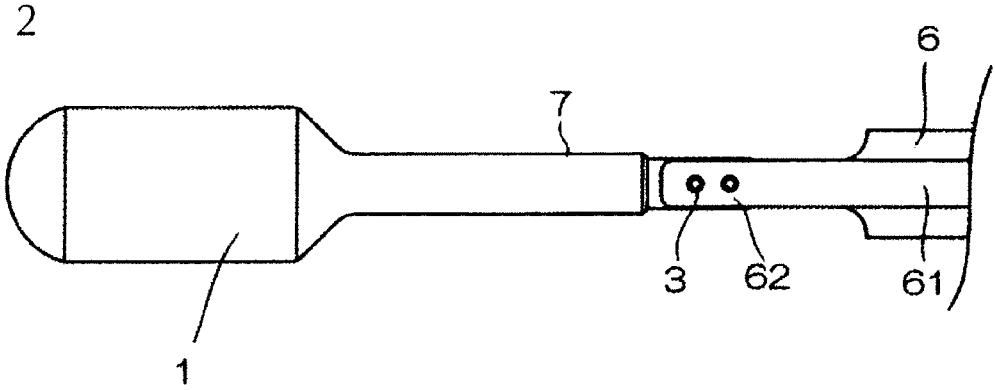
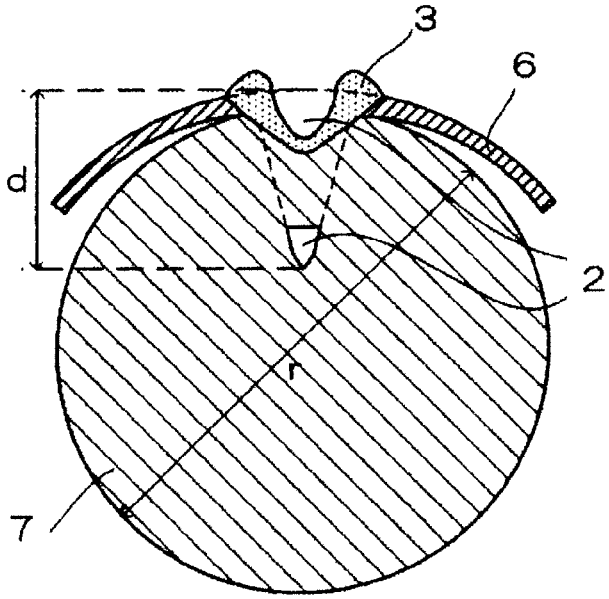
Fig. 3

Fig. 4
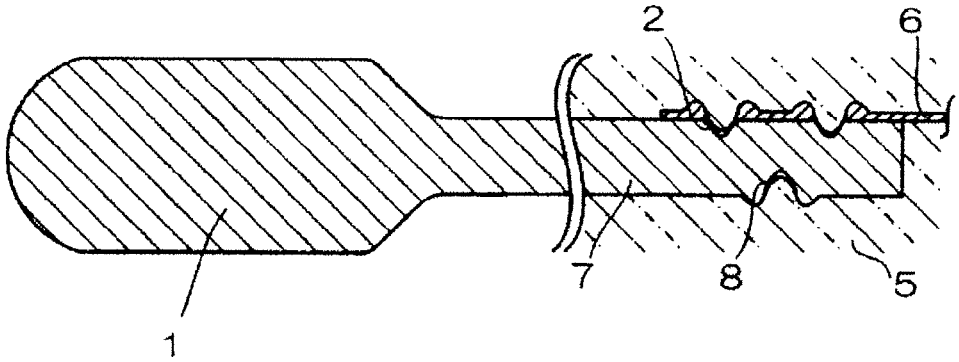
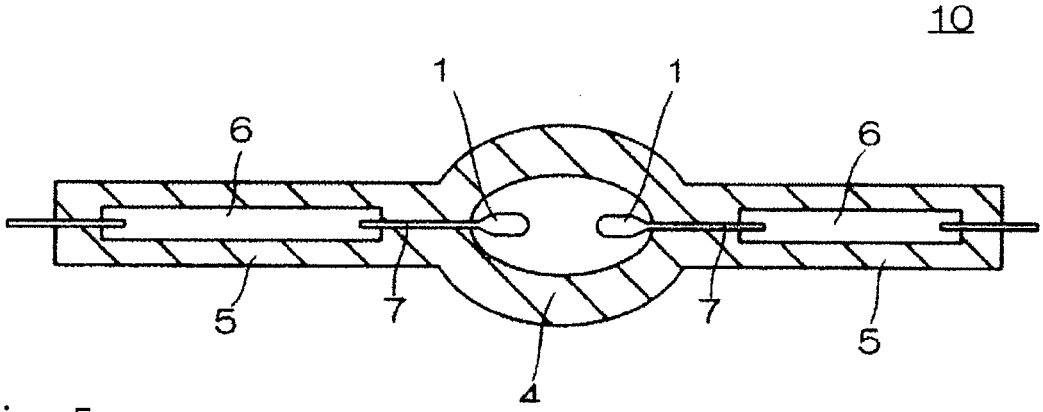
Fig. 5
(Prior Art)

HIGH PRESSURE DISCHARGE LAMP

BACKGROUND OF THE INVENTION

1. Field of the Invention

The present invention relates to high pressure discharge lamps used in devices such as data projectors, liquid crystal projectors or DLP (digital light processor) projectors. The invention relates in particular to high pressure discharge lamps wherein mercury is enclosed in the light emission part in an amount of at least 0.15 mg/mm$^3$ and the mercury vapor pressure becomes at least 110 atm.

2. Description of Related Art

Recently, liquid crystal projectors or DLP projectors using the digital light processing technology are becoming widespread. As the light source for the image projection, short arc type high pressure discharge lamps are used.

FIG. 5 is a partially sectional view showing the configuration of a high pressure discharge lamp shown in JP 2004-363014 A and corresponding to US 2005-003729 A1. The high pressure discharge lamp 10 is configured such that it comprises a discharge vessel consisting of a spherical light emission part 4 formed in the center portion and sealing parts 5 formed at both ends of said light emission part 4. In the interior of the light emission part 4, a pair of electrodes 1 is arranged, and core rods 7 of the electrodes 1 and metal foils 6 connected to the core rods 7 are buried and sealed air-tightly in the sealing parts 5. With such a high pressure discharge lamp 10, the expansion of the arc is suppressed by rendering the mercury vapor pressure at the time of switching-on high, and a further increase of the light output can be expected.

The core rod 7 of the electrode 1 and the metal foil 6 are joined by a laser. For example, laser light is irradiated from the metal foil 6 side, after the core rod 7 and the metal foil 6 have been closely contacted, and both are joined by melting both the molybdenum (Mo) constituting the metal foil 6 and the tungsten (W) constituting the core rod 7. As it is possible to fuse the core rod 7 and the metal foil 6 together, when performing the joining using a laser, the reliability of the electric connection can be improved and the joining strength can be increased.

With this kind of lamp, the core rod 7 of the electrode 1 and the metal foil 6 expand thermally at the time of switching-on, while at the time of switching-off a contraction occurs because of the cooling. The core rod 7 adheres well to the glass constituting the sealing part 5 and hardly expands and contracts, but the metal foil 6 easily expands and contracts as the glass does not adhere to it as well as to the core rod 7. Therefore, the core rod 7 hardly expands and contracts thermally while the metal foil 6 easily expands and contracts thermally at the times of switching-on and switching-off of the high pressure discharge lamp 10.

When the switching-on and switching-off of the high pressure discharge lamp is performed repeatedly while keeping the different amounts of thermal expansion and contraction between the core rod 7 and the metal foil 6 as they are, the thickness of the portion of the metal foil 6 overlapping the core rod 7 becomes thin and the electric load acting on the metal foil 6 becomes high. From experience, a bending of the end of the core rod at the metal foil 6 side is also known. The metal foil 6 is heated by the increase of the electric load and is, in addition, pressed by the bending of the core rod 7 and fuses.

SUMMARY OF THE INVENTION

The present invention was made to solve the abovementioned problems. Thus, a primary object of the present invention is to provide a high pressure discharge lamp in which no fusing of the metal foil occurs even if the high pressure discharge lamp is switched on for a certain time.

A first aspect of the aspect of the present invention relates to a high pressure discharge lamp comprising: a discharge vessel comprised of a light emission part and sealing parts made of glass connected to opposite ends of said light emission part; metal foils buried in a respective one of said sealing parts; a pair of electrodes comprised of core rods and tip end parts, said tip end parts being arranged oppositely to each other in the light emission part; and said core rods being melted and fused together with a respective one of the metals foils; wherein cavities are formed which reach from a surface of a respective one of the metal foils to an interior of the core rod, and the glass constituting said sealing part has entered into said cavities.

The second aspect of the present invention is characterized in that in the first aspect the glass constituting said sealing part intrudes deeper into the cavities than to the metal foil.

The third aspect of the present invention is characterized in that in the second aspect a depression is formed also in the surface of the core rod contacting the glass constituting the sealing part, and said glass intrudes into said depression.

The fourth aspect of the present invention is characterized in that in the second aspect a ratio d/r amounts to at least 0.35 and at most 0.60, with d being the length from the surface of said metal foil to the deepest part of said cavities and r being the diameter of the core rod of said electrode.

In the high pressure discharge lamp pursuant to the first aspect of the invention, because of the intrusion of the glass into the cavities, formed along with said melting and fusing together with the metal foil and reaching from the surface of the metal foil to the interior of the core rod, the glass forms a key and also the metal foil is hardly thermally expanding and contracting. The amount of the expansion and contraction of the metal foil is impaired and the difference in the amounts of the thermal expansion and contraction between the core rod and the metal foil because of the different adhesion states of the glass constituting the sealing part can be reduced. As the high pressure discharge lamp is switched on and off in such a condition, bending of the core rods of the electrodes can be avoided and also the fusing of the metal foil can be suppressed.

In the high pressure discharge lamp pursuant to the second aspect of the present invention, because the glass constituting the sealing part intrudes deeper into the cavities than to the metal foil and motions not only of the metal foil but also of the core rod are constrained, not only the expansion and contraction of the metal foil is impaired but also the amounts of the expansion and contraction of both the metal foil and the core rod are made approximately uniform.

According to the high pressure discharge lamp pursuant to the third aspect of the present invention, because a depression is also provided in the surface of the side face contacting the glass and the glass is made to intrude into this depression and to hardly expand and contract, an adjustment to the amount of the thermal expansion and contraction of the side face of the core rod contacting the metal foil becomes possible. The amounts of the thermal expansion and contraction become approximately uniform at any side face of the core rod in the circumferential direction, and a bending of the core rod can be avoided even more efficiently.

In the high pressure discharge lamp pursuant to the fourth aspect of the present invention, by forming the electrodes such that d/r amounts to at least 0.35 and at most 0.60, a sufficient welding strength can be provided and the cavities can be designed in a shape into which the glass intrudes.

BRIEF DESCRIPTION OF DRAWINGS

FIG. 1 is a partially enlarged view schematically showing the configuration of a high pressure discharge lamp according to a first embodiment of the invention.

FIG. 2 is a top view schematically showing the electrode and the metal foil of the first embodiment of the invention.

FIG. 3 is a sectional view schematically showing the laser light irradiation portion shown in FIG. 2 enlarged.

FIG. 4 is an enlarged sectional view schematically showing the electrode and the metal foil of a second embodiment of the invention.

FIG. 5 is an explanatory view schematically showing the configuration of a prior art high pressure discharge lamp.

DETAILED DESCRIPTION OF THE INVENTION

FIG. 1 is a partially enlarged view showing the configuration of a high pressure discharge lamp 10 of a first embodiment of the invention.

The high pressure discharge lamp 10 has an approximately spherical light emission part 4 made from quartz glass. In this light emission part 4 electrodes 1 made from tungsten are arranged oppositely to each other. Sealing parts 5 are formed such that they extend from the end parts of the light emission part 4, and in these sealing parts 5 a metal foil 6 for the electric conduction made from, for example, molybdenum is buried air-tightly by shrink-sealing. The pair of electrodes 1 consists of a tip end part with a large diameter and a core rod 7 with a small diameter, and the core rod 7 is welded to the metal foil 6 and electrically connected.

Mercury, a rare gas and a halogen gas are enclosed in the light emission part 4. To obtain the necessary visible light wavelengths, for example radiation light with wavelengths from 360 nm to 780 nm, mercury is enclosed in an amount of at least 0.15 mg/mm$^3$. Although this enclosed mercury amount differs according to the temperature conditions, it is produced such that at the time of operation the internal pressure of the light emission part 4 reaches an extremely high vapor pressure of at least 150 atm. By enclosing even more mercury a high pressure discharge lamp 10 in which the mercury vapor pressure at the time of operation is at least 200 atm or at least 300 atm can be produced and a light source suited for a projector device can be realized.

The rare gas is used to improve the lighting starting characteristics, and for example approximately 13 kPa argon are enclosed.

The halogen is enclosed in the form of a compound of iodine, bromine, chlorine and the like with mercury or another metal, and the enclosed amount of the halogen is chosen within a range from $1\times10^{-6}$ to $1\times10^{-2}$ μmol/mm$^3$. By enclosing a halogen the halogen cycle is generated and the durability of the high pressure discharge lamp 10 can be extended. In case of small-scale lamps having a high internal pressure such as the high pressure discharge lamp 10 of the present invention, by means of enclosing a halogen blackening and devitrifiction of the light emission part 4 can be avoided.

The core rod 7 of the electrode 1 is welded and joined to the metal foil 6 made from a thin foil of molybdenum (Mo) by a laser at several positions in the axial direction. The core rod 7 and the metal foil 6 in the joined condition are buried in the sealing part 5 by shrink sealing, so that a structure is obtained in which the periphery is covered with quartz glass.

To show a numerical example for a high pressure discharge lamp 10, the maximum outer diameter of the light emission part 4 is 11.3 mm, the electrode spacing is 1.1 mm and the internal volume of the light emission part 4 is 115 mm$^3$. The core rod diameter of the electrodes 1 is 0.3 mm to 1.0 mm, the thickness of the metal foil 6 is 20 μm and the axial length of the overlapping part of the core rod 7 and the metal foil 6 amounts to 1 to 2 mm. The high pressure discharge lamp 10 is arranged in a projector device, and with the miniaturization of the device, also a miniaturization of the high pressure discharge lamp 10 is desired. As also high luminance of the high pressure discharge lamp 10 is demanded, also the applied energy is high and the thermal influence in the interior of the light emission part 4 becomes extremely severe. The value of the tube wall load (the applied energy per unit surface of the internal surface of the light emission part 4) of the high pressure discharge lamp 10 amounts to 0.8 to 3.0 W/mm$^2$ and concretely to 2.5 W/mm$^2$.

The high pressure discharge lamp 10 with such a high mercury vapor pressure and tube wall load value can be mounted in a device for presentation such as a projector device and can provide radiant light with good color rendering characteristics.

In the following, the method to weld the metal foil 6 and the core rod 7 by means of laser irradiation will be explained on the basis of FIG. 2. FIG. 2 is a top view of the core rod 7 and the metal foil 6.

The metal foil 6 has the sectional shape of the character 'Ω' wherein in the central portion a central curved surface 61 extending in the axial direction is formed corresponding to the periphery of the core rod 7, while the ends are flat faces. The central curved surface 61 extends at one end of the metal foil 6 and an overlapping portion 62 connecting to the core rod 7 is formed.

In FIG. 2, a metal foil 6 with a sectional shape of the character 'Ω' is used, but also a metal having a sectional shape of a flat plate can be used.

In the overlapping portion 62, in which the central curved surface 61 of the metal foil 6 and the core rod 7 are arranged overlappingly, laser light is irradiated from the metal foil 6 side towards several positions and melt openings 3 are formed. For the laser light, a YAG laser or a fiber laser, and as an alternative to laser light, an electron beam etc. can be used. The energy density is set to at least 17 J/mm$^2$, and for example a laser beam with 1.2 J is radiated with a spot diameter of 0.3 mm.

FIG. 3 is a sectional view showing the laser light irradiation portion shown in FIG. 2 enlarged. More precisely, it is a vertically cut sectional view with regard to the axis of the core rod 7 passing through the center of the welding opening 3 thought to be the center part of the impingement of the laser.

When laser light is radiated, it passes through the metal foil 6 made from molybdenum (Mo) being the upper material of the overlapping materials, and the core rod 7 made from tungsten (W) being the lower material spurts out. A part of the tungsten (W) having spurted out sublimates, but the main part flows in the vicinity as the viscosity of the surface decreases, runs onto the metal foil 6 and covers the periphery of the opening formed in the surface of the metal foil 6 like a pad. The welding openings 3 are formed such that the molten tungsten rises above the metal foil 6 and covers the openings formed in the metal foil 6.

As the tungsten (W) forming the core rod 7 spurts out and sublimates when being thermally affected by the laser welding, a cavity 2 is formed in the interior of the core rod 7. The cavity 2 formed in the core rod 7 is formed in the portion being thermally affected by the laser, and the depth of the cavity differs according to the energy density of the laser. Occasionally, the center melts and becomes buried, and there is a separation into an upper portion and a lower portion. The depth d of the cavity 2 is the length from the surface of the metal foil 6 to the deepest part of the cavity 2, that is, in case of a separation into an upper portion and a lower portion, to the bottom part of the lower portion.

By means of the laser welding, the welding openings are formed such that the molten tungsten covers the openings of the metal foil 6. The electrode structure, for which the core rod 7 and the metal foil 6 have been joined, is inserted into a cylindrical quartz glass tube, the cylindrical tube is heated and shrunk and a sealing part 5 is formed. As the quartz glass forming the sealing part 5 adheres to the core rod 7 and the metal foil 6, it also intrudes into the interior of the welding openings 3. The glass having entered the cavities 2 formed in the core rod 7 by means of the laser performs the task of a key securing the original position such that there is no large motion of the core rod 7 and the metal foil 6.

Because the glass intrudes into the cavities 2 having been formed by means of the laser welding such that they pass through the metal foil 6 and reach the core rod 7, the glass forms a key and also the metal foil 6 hardly expands and contracts. The amount of the expansion and contraction of the metal foil 6 is impaired and the difference in the amounts of the expansion and contraction of the core rod 7 and the metal foil 6 because of the different adhesion states of the glass constituting the sealing part 5 can be reduced. As the high pressure discharge lamp 10 can be switched on and switched off in a state, in which the amounts of the thermal expansion and contraction of the metal foil 6 and the core rod 7 are approximately uniform, bending of the core rods 7 of the electrodes 1 can be avoided and also fusing of the metal foil 6 can be suppressed.

It is preferred that the quartz glass constituting the sealing parts 5 intrudes deeper into the interior of the cavities 2 following the welding openings 3 than to the surface of the core rod 7. A deep intrusion of the glass into the cavities 2 and a constraint of not only motions of the metal foil 6 but also of the core rod 7 result in that not only the expansion and contraction of the metal foil 6 is impaired but also the amounts of the expansion and contraction of the metal foil 6 and the core rod 7 are made approximately uniform.

In the following, a second embodiment is explained. FIG. 4 is an enlarged sectional view showing the electrode and the metal foil of the second embodiment.

In the second embodiment not only cavities 2 are formed in the side face of the core rod 7 of the electrode 1 contacting the metal foil 1 to reduce the difference in the amounts of the thermal expansion and contraction between the core rod 7 and the metal foil 6, but also a depression 8 is formed in the surface of the side face contacting the glass constituting the sealing part 5, and the glass is made to intrude into this depression 8. If only the side face of the core rod 7 contacting the metal foil 6 is made hardly expanding and contracting, the side face of the opposite side of the core rod 7 expands and contracts thermally as before and there may be cases in which the amounts of the thermal expansion and contraction differ depending on the side face in the circumferential direction of the core rod 7.

By means of providing a depression 8 also in the surface of the side face contacting the glass, making the glass intrude into the depression and rendering the expansion and contraction difficult, an adjustment to the amount of the thermal expansion and contraction of the side face of the core rod 7 contacting the metal foil 6 becomes possible. The amounts of the thermal expansion and contraction become approximately uniform at any side face of the core rod 7 in the circumferential direction, and a bending of the core rod 7 can be avoided even more efficiently.

In the following, concrete examples will be explained.

Electrode structures laser-welded with a metal foil were prepared while the diameter of the core rod of the electrode and the depth of the cavities were varied. Then, the welding strength and the intrusion or non-intrusion of the glass into the cavities were examined. The specifications of the high pressure discharge lamp being the test object were as follows.

Electrodes: material: tungsten; core rod diameter: 0.4 mm; core rod length: 6.7 mm.

Metal foil: material: molybdenum; thickness: 20 μm; length of the overlap with the electrode: 1.55 mm.

Welding: YAG laser; two positions in the axial direction; energy density: 17 to 21 J/mm$^2$.

Sealing parts: material: quartz glass; diameter: approximately 5.5 mm.

The sealing parts were formed by shrinking a cylindrical tube with a thickness of 2 mm and a diameter of 6 mm.

As the depth of the cavities formed in the electrodes by the laser welding is also the achieved depth which is thermally affected by the laser, it can be arranged to a suitable value by selecting the energy density of the laser. And as it is necessary to make the diameter of the electrodes used in the high pressure discharge lamp extremely small with a diameter of about 0.3 to 1.0 mm, the depth of the cavities cannot be made too large.

As shown in FIG. 3, there may be cases in which the cavities formed by the laser welding are divided into an upper portion and a lower portion while the center is molten and buried. As the depth of the cavities means an achieved depth which is thermally affected by the laser, it is here, in case of a separation into an upper portion and a lower portion, the length d to the bottom part of the lower portion. To precisely measure the depth of the cavity, the distance from the surface of the metal foil to the deepest part of the cavity is laser-measured in a cross-section cut such that it passes through the center of the welding opening thought to be the center of the impingement of the laser.

The test results are shown in table 1. With 'd/r' being the parameter, using the depth of the cavity d and the diameter of the electrode core rod r as variables, the welding strength and the glass intrusion were determined while d/r was varied to assume various values. Regarding the welding strength, as it is known that there are no problems with regard to the performance of a high pressure discharge lamp when the peel strength of the welded part of the core rod and the metal foil amounts to at least 60 g, a peel strength of at least 60 g was considered to be '○' while a peel strength of less than 60 g was considered to be 'x'. The peel strength is the measurement value at the time of peeling in case of a connection to, for example, a push-pull gauge and pulling from the core rod into the peeling direction. Regarding the glass intrusion, an intrusion being deeper than to the core rod surface was considered to be '○' while no intrusion of the glass or an intrusion being shallower than to the core rod surface was considered to be 'x'.

TABLE 1

| d/r | Welding strength | Glass intrusion |
|---|---|---|
| 0.10 | X | X |
| 0.15 | X | X |
| 0.20 | X | X |
| 0.25 | X | X |
| 0.30 | ○ | X |
| 0.35 | ○ | ○ |
| 0.40 | ○ | ○ |
| 0.45 | ○ | ○ |

TABLE 1-continued

| d/r | Welding strength | Glass intrusion |
|---|---|---|
| 0.50 | ○ | ○ |
| 0.55 | ○ | ○ |
| 0.60 | ○ | ○ |
| 0.65 | X | ○ |
| 0.70 | X | ○ |

Regarding the welding strength, it was found out that there was no sufficient joining and a peeling-off occurred when d/r amounted to 0.25 and less, while the metal foil was melted too much and was severed, when d/r amounted to 0.65 and more. When the welding part was formed such that d/r was at least 0.30 and at most 0.60, the peeling strength became at least 60 g and a sufficient welding strength was provided.

Regarding the glass intrusion, it was found out that the cavities are too small and there is no glass intrusion when d/r amounts to 0.30 and less. When the electrodes are formed such that d/r is 0.35 and more, the glass can be made to intrude deeper into the cavities than to the surface of the metal foil.

From the above test results it was recognized that a sufficient welding strength is provided while an intrusion of the glass into the cavities is achieved when the electrodes are formed such that d/r is in the range from 0.35 to 0.60.

What is claimed is:

1. A high pressure discharge lamp comprising:

a discharge vessel comprised of a light emission part and sealing parts made of glass connected to opposite ends of said light emission part;

a pair of electrodes comprised of core rods and tip end parts, said tip end parts being arranged oppositely to each other in the light emission part; and metal foils which are melted and fused to core rods of said electrodes and buried in said sealing parts;

wherein cavities are formed which reach from a surface of the metal foil to an interior of the core rod in conjunction with said melting and fusing and the glass constituting said sealing part has entered into said cavities.

2. A high pressure discharge lamp according to claim 1, wherein the glass constituting said sealing part has entered deeper into the cavities than the surface of the core rod.

3. A high pressure discharge lamp according to claim 2, wherein a depression is formed also in a surface area of the core rod contacting the glass constituting the sealing part, and said glass has entered into said depression.

4. A high pressure discharge lamp according to claim 2, wherein a ratio d/r lies in a range of 0.35 to 0.60, with d being the length from the surface of said metal foil to the deepest part of said cavities and r being the diameter of the core rod of said electrode.

* * * * *